US005338469A

United States Patent [19]

Nelson et al.

[11] Patent Number: 5,338,469

[45] Date of Patent: Aug. 16, 1994

[54] MANNICH TYPE COMPOUNDS AS ANTIOXIDANTS

[75] Inventors: Lloyd A. Nelson, Yardley, Pa.; Leslie R. Rudnick, Lawrenceville, N.J.

[73] Assignee: Mobil Oil Corporation, Fairfax, Va.

[21] Appl. No.: 986,208

[22] Filed: Dec. 7, 1992

[51] Int. Cl.[5] ..... C10M 159/16

[52] U.S. Cl. ..... 252/49.6; 252/51.50 R; 564/390

[58] Field of Search ..... 252/49.6, 51.5 R; 564/390

[56] References Cited

U.S. PATENT DOCUMENTS

| | | | |
|---|---|---|---|
| 3,948,619 | 4/1976 | Worrel | 44/415 |
| 4,398,921 | 8/1983 | Rifkin et al. | 44/415 |
| 4,810,354 | 3/1989 | Roling et al. | 252/51.5 R |
| 4,900,427 | 2/1990 | Weers et al. | 44/415 |
| 4,914,246 | 4/1990 | Oswald et al. | 568/793 |
| 5,043,086 | 8/1991 | Blain et al. | 252/51.5 R |
| 5,089,156 | 2/1992 | Chrisope et al. | 252/49.9 |

*Primary Examiner*—Jacqueline V. Howard
*Attorney, Agent, or Firm*—Alexander J. McKillop; George W. Hager, Jr.; Charles A. Malone

[57] ABSTRACT

A combination of Mannich type reaction products of ethoxylated alkylated phenol, and alkylated arylamine possess excellent antioxidant properties. The presence of alkylated phenol in the structure is believed to provide a synergistic antioxidant activity with the aromatic amine. Presence of the alkylated aromatic moiety is believed to provide enhanced lubricant solubility compared to unalkylated diphenylamine type antioxidants. Application of these synergistic mixtures of additives and synthetic base stocks in premium automotive and industrial lubricants will significantly enhance stability and extend service life.

11 Claims, No Drawings

MANNICH TYPE COMPOUNDS AS ANTIOXIDANTS

FIELD OF THE INVENTION

This invention relates to Mannich base reaction products and to lubricant and fuel compositions containing same. This invention is also directed to a method of preparing these reaction products which are particularly useful in lubricating oils, fuels, greases and plastics as antioxidant additives.

BACKGROUND OF THE INVENTION

Lubricants, such as lubricating oils and greases, are subject to oxidative deterioration at elevated temperatures or upon prolonged exposure to the elements. Such deterioration is evidenced, in many instances, by an increase in acidity and in viscosity, and when the deterioration is severe enough, it can cause metal parts to corrode. Additionally, severe oxidation leads to a loss of lubrication properties, and in especially severe cases this may cause complete breakdown of the device being lubricated. Many additives have been tried, however, many of them are only marginally effective except at high concentrations. Improved antioxidants are clearly needed.

Antioxidants or oxidation inhibitors are used to minimize the effects of oil deterioration that occur when hot oil is contacted with air. The degree and rate of oxidation will depend on temperature, air and oil flow rates and, of particular importance, on the presence of metals that may catalytically promote oxidation. Antioxidants generally function by prevention of chain peroxide reaction and/or metal catalyst deactivation. They prevent the formation of acid sludges, darkening of the oil and increases in viscosity due to the formation of polymeric materials.

Water (moisture) is another critical problem. In spite of even extraordinary precautionary efforts water is found as a film or in minute droplets in vessels containing various hydrocarbon distillates. This brings about ideal conditions for corrosion and damage of metal surfaces of the vessels and the materials contained therein. Also in the lubrication of internal combustion engines, for example, quantities of water are often present as a separate phase within the lubricating system. Another serious problem in respect to metallic surfaces in contact with adjacent metallic surfaces is the surface wear caused by the contact of such surfaces. One material capable of simultaneously effectively coping with such problems as these is highly desirous.

It has now been found that the use of a combination of Mannich type reaction products of ethoxylated alkylated phenol, and alkylated arylamine provide exceptional antioxidant activity. These remarkable benefits are to be expected for a variety of synthetic and mineral oil based lubricants.

To the best of our knowledge, this combination has not been previously used as additives in lubricating oils or greases. The additive products themselves and lubricant compositions thereof are both believed to be novel.

The use of arylamines as antioxidants in a variety of lubricant polymers and rubber applications is known. Also, the use of phenols are reported as having antioxidant properties, especially a low temperatures.

It has now been found that incorporative elements of phenol with alkylated arylamine provide exceptional synergistic antioxidant and high temperature stabilities.

These elements also provide for good fluidity and enhanced oil solubility, far surpassing expectations.

SUMMARY OF THE INVENTION

This invention is directed to lubricant compositions containing a combination of Mannich type reaction products of ethoxylated alkylated phenol and alkylated arylamine. The presence of alkylated phenol in the ethoxylated alkylated phenol is believed to provide a synergistic antioxidant activity with the alkylated arylamine. The presence of the alkylated aromatic moiety is believed to provide enhanced lubricant solubility compared to unalkylated diphenylamine type antioxidants. Inclusion of synergistic mixtures of compositions containing these reaction products into additives and synthetic base stocks in premium automotive and industrial lubricants will significantly enhance their stability and extend their service life. Extended service life is obtained due to the inclusion of boron into the reaction products which improves antiwear properties.

Although the exact mechanism of operation is unknown and this invention is not limited to a particular theory, all of these beneficial properties are believed to be enhanced as a result of this novel internal synergism. This unique internal synergism concept is believed to be applicable to similar structures containing (a) oxylated alkylated phenols, (b) alkylated arylamines, and (c) aliphatic aldehydes when combined under conditions suitable for obtaining Mannich-type reaction products. Resultant products of this invention show good stability and compatibility when used in the presence of other commonly used additives in lubricant compositions.

It is therefore an object of this invention to provide lubricant compositions of improved antioxidant characteristics.

It is another object of this invention to provide novel additives derived from the hereinbelow described Mannich condensation products.

BRIEF DESCRIPTION OF THE PREFERRED EMBODIMENTS

The following generalized reaction sequence exemplifies compositions that can be made from this invention by using the compounds below under conditions suitable to obtain Mannich-type reaction products.

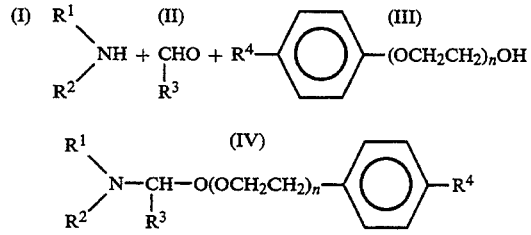

where $R^1$ and $R^2$ are the same or different and are phenyl, naphthyl, alkyl-naphthyl, or p-tolyl; where $R^3$ is selected from hydrogen and alkyl radicals containing from 1 to 8 carbon atoms; and where $R^4$ is $C_5$ to $C_{35}$ alkyl and n is 1 to 100.

As indicated above compound (I) represents an aromatic amine (also known as "aryl amine"). These compounds are well known. Representative examples of these compounds are diphenyl phenylenediamine, octylated diphenylamine, N-Phenyl-N'-(1,3-dimethylbutyl)p-phenylenediamine 4,4'-bis (alpha alpha-dimethylbenzyl) diphenylamine and (4-anilinophenyl)-methacrylate. A commercial product which can be used herein is marketed by Uniroyal, Inc. as NAUGARD ® 445 Antioxidant. Their use as antioxidants for a variety of polymeric materials are known from U.S. Pat. Nos. 3,452,056 and 3,505,225. These patents are hereby incorporated by reference herein.

Compound (II) as shown above represents an aldehyde. Aldehydes having the following generalized formula are suitable for use in the condensation reaction of the present invention:

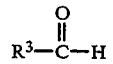

wherein R is selected from hydrogen and alkyl radicals containing from 1 to about 8 carbon atoms. Examples of suitable aldehydes include formaldehyde, acetaldehyde, propanaldehyde, butrylaldehyde, hexaldehyde and heptaldehyde. The most preferred aldehyde reactant is 2-ethylhexanal, which may be used in its monomeric or its polymeric form.

As depicted above, compound (III) represents an oxylated alkylated phenol. Ethoxylated alkylated phenol is a preferred oxylated alkylated phenol which can be used herein. Examples of ethoxylated alkylated phenols for use herein include ethoxylated nonyl phenol with 5 to 20 ethylene oxide units per molecule, and ethoxylated octyl phenol containing 5 to 15 ethylene oxide units per molecule. A representative ethoxylated alkylated phenol for use herein is marketed by Exxon Chemicals Inc. as ECA ® 6929. These representative compounds are disclosed in U.S. Pat. Nos. 5,089,156 and 4,914,246 which issued to Exxon Chemical Patents Inc. These patents are hereby incorporated by reference herein.

Reaction products obtained from the Mannich type reaction above are shown in (IV) above. When conducting this reaction, more than or less than molar quantities of aromatic amine or alkylated phenol can be used. Alkylated phenolpolyol can be used in lieu of the alkylated phenol. Reaction temperatures of 120° C. and above can be utilized. The reaction time will be about 2–24 hours. Diarylamines can be used as the aromatic amine. These are known in the art. While not shown above, boric acid is added into the reaction. It is anticipated that the presence of boron will give antiwear properties to the reaction product.

The additives may be incorporated into any suitable lubricating media which comprises oils of lubricating viscosity, e.g., mineral, vegetable, or synthetic; or mixtures of mineral, vegetable, and synthetic or greases in which the aforementioned oils are employed as a vehicle or into such functional fluids as hydraulic fluids, brake fluids, power transmission fluids and the like. In general, mineral oils and/or synthetic, employed as the lubricant oil, or grease vehicle may be of any suitable lubricating viscosity range, as for example, from about 45 SSU at 100° F. to about 6,000 SSU at 100° F., and, preferably, from about 50 to about 250 SSU at 210° F. These oils may have viscosity indices from below zero to about 100 or higher. Viscosity indices from about 70 to about 95 are preferred. The average molecular weight of these oils may range from about 250 to about 800. Where the lubricant is to be employed in the form of a grease, the lubricating oil is generally employed in an amount sufficient to balance the total grease composition, after accounting for the desired quantity of the thickening agent and other additive components to be included in the grease formulation.

In instances where synthetic oil, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylolpropane esters, neopentyl and pentaerythritol esters, di(2-ethylhexyl) sebacate, di(2-ethylhexyl) adipate, dibutyl phthalate, flurocarbons, silicate esters, silanes, esters of phosphorous-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis (p-phenoxy phenyl) ether, phenoxy phenylethers, etc.

Fully formulated lubricating oils may include a variety of additives (for their known purpose) such as dispersants, detergents, inhibitors, antiwear agents, antioxidants, friction modifiers, antifoams, pour depressants and other additives including phenates, sulfonates and zinc dithiophosphates.

As hereinbefore indicated, the aforementioned additive compounds may be incorporated as multifunctional agents in grease compositions. When high temperature stability is not a requirement of the finished grease, mineral oils having a viscosity of at least 40 SSU at 150° F., and particularly those falling within the range from about 60 SSU to about 6,000 SSU at 100° F. may be employed. The lubricating vehicles of the improved greases of the present invention, containing the above described additives, are combined with a grease forming quantity of a thickening agent. For this purpose, a wide variety of materials are dispersed in the lubricating vehicle in grease-forming quantities in such degree as to impart to the resulting grease composition the desired consistency. Exemplary of the thickening agents that may be employed in the grease formulation are non-soap thickeners, such as surface-modified clays and silicas, aryl ureas, calcium complexes and similar materials. In general, grease thickeners may be employed which do not melt and dissolve when used at the required temperature within a particular environment; soap thickeners such as metallic (lithium or calcium) soaps including hydroxy stearate and/or stearate soaps can be used however, in all other respects, any material which is normally employed for thickening or gelling hydrocarbon fluids or forming greases can be used in preparing the aforementioned improved greases in accordance with the present invention.

Included among the preferred thickening agents are those containing at least a portion of alkali metal, alkaline earth metal or amine soaps of hydroxyl-containing fatty acids, fatty glycerides and fatty esters having from 12 to about 30 carbon atoms per molecule. The metals are typified by sodium, lithium, calcium and barium. Preferred is lithium. Preferred members among these acids and fatty materials are 12-hydroxystearic acid and glycerides containing 12-hydroxystearates, 14-hydroxystearic acid, 16-hydroxystearic acid and 6-hydroxystearic acid.

The reaction products are highly useful as multifunctional antioxidant/anticorrosion agents. They are added to the lubricating medium in amounts sufficient to impart such properties to the lubricant. More particularly, such properties will be imparted to the lubricant by adding from about 0.001% to about 10% by weight, preferably from about 0.01% to about 3%, of the neat product.

The examples which appear below demonstrate the efficacy of this invention. These examples are illustrative only.

EXAMPLE 1

A four-neck round-bottomed flask was charged with Naugard ® 445 (41.5 g 0.1 mol), 2-ethylhexanal (12.8 g, 0.1 mol), ECR ® 6929 (61.4 g, 9.1 mol) and toluene (200 ml) under an inert atmosphere. The moisture was brought to reflux for 3 hours under azeotropic conditions (1.8 ml of water was collected). The mixture was cooled to 70 ° C. and boric acid (62 g, 0.2 mol) was added in portions as the mixture was gradually brought to reflux with azeotropic removal of water until no more water came off. The reaction mixture was filtered hot over celite and concentrated to give LAN 0072 (90 g).

EXAMPLE 2

A lubricating composition was made by blending a monoalkylated aromatic base oil A (hexadecyldiphenyloxide) with 1.0% LAN 0072. The completely homogenous mixture demonstrates that additive solubility is excellent. Testing of this mixture in the Catalytic Oxidation Test at high temperatures (325° F./40 hours) shows that there is improvement in lead loss as shown in Table 2.

EXAMPLE 3

A lubricating composition was made by blending a monoalkylated aromatic base oil B (hexadecyldiphenylmethane) with 1.0% LAN 0072. The completely homogenous mixture demonstrates that additive solubility is excellent. Testing of this mixture in the Catalytic Oxidation Test at high temperatures (325° F./40 hours) shows that there is a very significant improvement in the oxidative stability as measured by sludge formation (Table 2).

EXAMPLE 4

A lubricating composition was made by blending a monoalkylated aromatic base oil C (hexadecyldiphenylsulfide) with 1.0% LAN 0072. The completely homogenous mixture demonstrates that additive solubility is excellent. Testing of this mixture in the Catalytic Oxidation Test at high temperatures (325° F./40 hours) shows that there is a very significant improvement as measured by viscosity control (Table 2). Sludge, lead loss and total acid number (TAN) are also reduced as shown in Table 2.

Evaluation of the Products

The alkylated amine and oxylated alkylated phenol derived condensation products were blended into mineral oils and evaluated for antioxidant performance by the Catalytic Oxidation Test at 325° F. for 40 hours (Table 1). A comparison of the effect of additive (LAN 0072) on the oil stability characteristics of the inventive products with traditional antioxidants in similar mineral oils is included in Table 2 below. As is demonstrated in column 6 of Table 2, alkylated aromatic base oil C when combined with the additive shows a remarkable improvement in the TAN, viscosity retention, lead loss, and sludge formation when compared to the other oils, even with the additive.

Catalytic Oxidation Test

The test lubricant composition is subjected to a stream of air which is bubbled through the composition at a rate of 5 liters per hour at the specified temperature for the required number of hours. Present in the composition (comprising a 200 second solvent refined paraffinic neutral oil) in addition to the additive compound were metals commonly used as materials to construct engines namely:

(a) 15.6 square inch of sand-blasted iron wire;
(b) 0.78 square inch of polished copper wire;
(c) 0.87 square inch of polished aluminum wire; and
(d) 0.107 square inch of polished lead surface.

As noted above, the test results are reported in Table 1.

TABLE 1

| Item | Catalytic Oxidation Test 40 Hours at 325° F. Additive Conc. (Wt %) | Change In Acid Number TAN | Percent Change In Viscosity KV |
|---|---|---|---|
| Base Oil (200 second solvent refined, paraffinic neutral, mineral oil | — | 14.21 | 459.0 |
| Example 1 | 1.0 | 7.62 | 19.43 |
| Naugard 445 | 1.0 | 9.48 | 109.79 |

TABLE 2

EFFECT OF ADDITIVE ON OIL STABILITY

| | 1 | 2 | 3 | 4 | 5 | 6 |
|---|---|---|---|---|---|---|
| SAMPLE | ALKYLATED AROMATIC BASE OIL A | ALKYLATED AROMATIC BASE OIL A | ALKYLATED AROMATIC BASE OIL B | ALKYLATED AROMATIC BASE OIL B | ALKYLATED AROMATIC BASE OIL C | ALKYLATED AROMATIC BASE OIL C |
| ADDITIVES | | LAN0072 | | LAN0072 | | LAN0072 |
| WT % | | 1.00 | | 1.00 | | 1.00 |
| KV @ 40 C. | 23.6 | 23.63 | 20.23 | 20.23 | 26.46 | 26.46 |
| KV @ 100 C. | 4.4 | 4.45 | 4.21 | 4.21 | 4.80 | 4.80 |
| VI | 97 | 97 | 112 | 112 | 101 | 101 |
| B-10 @ 325 F./40H (M334-2) | | | | | | |
| % KV GAIN | 101 | 103 | 230 | 236 | 35.07 | 5.04 |
| TAN | 12.43 | 15.26 | 6.57 | 8.91 | 5.58 | 0.56 |
| % Pb loss | 57.8 | 44.29 | 27.9 | 25.06 | 21.39 | 0 |
| SLUDGE | MODERATE | MOD | MODERATE | LIGHT | HEAVY | LIGHT |
| RBOT, min (D2272) | 170 | | 58-67 | 61 | 840 | 1560 |

As shown above, the products of this invention exhibit very good antioxidant activity, especially under the very severe conditions shown in Tables 1 and 2. The products of this invention when used in premium quality automotive and industrial lubricants will significantly enhance the stability and extend the service life of the lubricant. These novel compositions described in this invention are useful at low concentrations and do not contain any potential undesirable metals or chlorine or phosphorus. These multifunctional antioxidants can be commercially made using known technology in existing equipment.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A composition comprising a major amount of an oil of lubricating viscosity or grease or other solid lubricant prepared therefrom and a minor multifunctional antioxidant/corrosion inhibiting amount of a product of reaction of;

(1) an arylamine having the generalized structure:

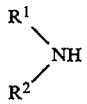

(2) an aldehyde having the general structure

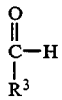

and (3) an oxylated alkylated phenol having the general structure

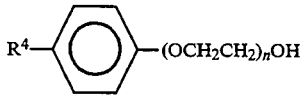

where $R^1$ and $R^2$ are the same or different and are phenyl, naphthyl, alkyl-naphthyl, or p-tolyl; $R^3$ is selected from hydrogen and alkyl radicals containing from 1 to 8 carbon atoms;

where $R^4$ comprises $C_5$ to $C_{35}$ alkyl; and n represents a number from 1 to 100.

2. The composition as recited in claim 1 where the product comprises at least one structure having the following generalized formula:

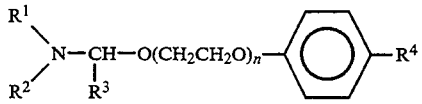

3. The composition as recited in claim 1 where the arylamine is diphenyl amine, the aldehyde is 2-ethylhexanol, and the oxylated alkylated phenol is ethoxylated nonyl phenol.

4. The composition as recited in claim 1 wherein the oil of lubricating viscosity is selected from a member of the group consisting of (1) mineral oils, (2) synthetic oils, (3) vegetable oils, or (4) mixtures of mineral, vegetable, and synthetic oils or (5) is a grease prepared from any one of (1), (2), (3) or (4).

5. The composition as recited in claim 1 wherein the oil of lubricating viscosity is selected from a member of the group consisting of (1) mineral oils, (2) synthetic oils, (3) vegetable oils, or (4) mixtures of mineral, vegetable, and synthetic oils or (5) is a grease prepared from any one of (1), (2), (3), or (4) and where said oil contains boron.

6. The composition as recited in claim 1 wherein the oil of lubricating viscosity is selected from a member of the group consisting of (1) mineral oils, (2) synthetic oils, (3) vegetable oils, or (4) mixtures of mineral, vegetable, and synthetic oils or (5) is a grease prepared from any one of (1), (2), (3), or (4) and where said oil contains boron which composition improves oil stability.

7. The composition as recited in claim 1 wherein the oil of lubricating viscosity is a monoalkylated diphenyloxide base oil.

8. The composition as recited in claim 1 wherein the oil of lubricating viscosity is a monoalkylated diphenylmethane base oil.

9. The composition as recited in claim 1 wherein the oil of lubricating viscosity is a monoalkylated diphenylsulfide base oil.

10. A product of reaction made by reacting (1) an arylamine, (2) an aldehyde, and (3) an ethoxylated alkylated phenol at temperatures in excess of about 120° C. or reflux and a pressure varying from atmospheric or slightly higher and where the quantities of (1), (2), and (3) utilized are molar, less than molar, or greater than molar.

11. The product as recited in claim 10 where the arylamine is diphenylamine, the aldehyde is 2-ethylhexanol, and the oxylated alkylated phenol is ethoxylated nonyl phenol which product contains additionally boron.

* * * * *